US006252188B1

(12) United States Patent
Zapata et al.

(10) Patent No.: US 6,252,188 B1
(45) Date of Patent: Jun. 26, 2001

(54) SORTER FOR AGRICULTURAL PRODUCTS

(75) Inventors: Donald F. Zapata; Elias H. Codding, both of Houston, TX (US)

(73) Assignee: Delta Technology Corporation, Houston, TX (US)

( * ) Notice: Subject to any disclaimer, the term of this patent is extended or adjusted under 35 U.S.C. 154(b) by 0 days.

(21) Appl. No.: 09/390,556

(22) Filed: Sep. 3, 1999

(51) Int. Cl.[7] ..... B07C 5/00; B07C 5/342

(52) U.S. Cl. ..... 209/577; 209/509; 209/581; 209/582; 209/587

(58) Field of Search ..... 209/509, 577, 209/581, 582, 587

(56) References Cited

U.S. PATENT DOCUMENTS

| | | | |
|---|---|---|---|
| 3,980,181 | 9/1976 | Hoover | 209/111.6 |
| 4,134,498 | 1/1979 | Jones | 209/564 |
| 4,308,959 | 1/1982 | Hoover | 209/563 |
| 4,454,029 | 6/1984 | Codding | 209/581 |
| 4,466,544 | 8/1984 | Satake et al. | 209/580 |
| 4,697,709 | 10/1987 | Codding | 209/549 |
| 4,878,582 | 11/1989 | Codding | 209/580 |
| 4,940,850 | 7/1990 | Satake | 209/580 |
| 5,179,474 | 1/1993 | Bailey | 359/798 |
| 5,193,782 | 3/1993 | Bailey | 251/129.21 |
| 5,197,159 | 3/1993 | Truong | 15/304 |
| 5,526,119 * | 6/1996 | Blit et al. . | |
| 5,638,961 * | 6/1997 | Satake et al. . | |
| 5,779,058 | 7/1998 | Satake | 209/581 |
| 6,013,887 * | 1/2000 | Satake et al. . | |
| 6,100,488 * | 8/2000 | Satake et al. . | |

* cited by examiner

*Primary Examiner*—Donald P. Walsh
*Assistant Examiner*—Jonathan R Miller
(74) *Attorney, Agent, or Firm*—Bracewell & Patterson, L.L.P.

(57) ABSTRACT

A sorter is provided for sorting unacceptable agricultural products or foreign objects from acceptable ones. Preferably, the sorter is a monochromatic one performed as the products pass in streams past an illuminated viewing station. The view station includes a plurality of aligned optical sensors. The optical sensors sense the reflected light from the stream of product passing the optical station and form electrical signals indicative of the sensed light. The electrical signals are then processed and the product is accepted or rejected based on its optical characteristics. The sorter may illuminate the product stream with a source capable of generating a visible light spectra or with a source capable of generating a near-infrared spectra. Each illumination source having specific mounting sockets in the sorter. Additionally, the sorter is capable of operating a near-IR source at a significantly reduced voltage whereby the working life of the source is greatly extended.

16 Claims, 4 Drawing Sheets

SORTER FOR AGRICULTURAL PRODUCTS

BACKGROUND OF THE INVENTION

1. Field of the Invention

The present invention relates to a color sorting apparatus for agricultural products capable of sorting products based on optically sensed characteristics using a light source with visible light spectra or a near-infrared ("near-IR") spectra.

2. Description of the Prior Art

Commonly owned U.S. Pat. No. 4,454,029, of which Applicant Codding is a named inventor, relates to a bichromatic sorter for agricultural products. These sorters have been primarily used to detect unacceptable agricultural products based on color of the product, such as coffee beans, peanuts and the like. There were certain types of relatively smaller, usually granular, agricultural products, such as rice grains, which required only monochromatic or gray level to sort to reject unacceptable products. Although the '029 sorter is capable of sorting products using two color illumination levels, the sorter employs only a visible spectrum illumination source. Some products cannot be sorted using normally visible light buy may be differentiated using light in the near-IR range. For instance, tree nuts, such as almonds, require a lower frequency light to distinguish between acceptable and unacceptable products. Lower frequency light is also useful in distinguishing between agricultural products and foreign materials, such as stems, glass and plastics, which are often inadvertently included with the products during harvest or subsequent processing.

Commonly owned U.S. Pat. No. 4,697,709, of which Applicant Codding is a named inventor, describes a monochromatic sorting apparatus having a plurality of optical stations. Each station is composed of a plurality of optical sensors which are capable of sensing light reflected from a stream of product. The stream is illuminated by fluorescent lamps. The apparatus is capable of using only one source of illumination (e.g. fluorescent) and is therefore not capable of sorting products which require differentiation based on their near-IR spectra.

U.S. Pat. No. 4,466,544 relates to a sorting apparatus having a plurality of movable filters which can be remotely actuated such that a specific filter may be selected for use depending on the nature of the product being sorted. This eliminates the need to physically remove and replace filters each time the product being sorted is changed, thereby making the apparatus more economical and efficient. However, the apparatus is designed to operate with only one type of light source, thereby limiting its capabilities to sorting only those products which can be differentiated using a light source of only a single spectra (e.g. visible light).

U.S. Pat. No. 5,779,058 involves a color sorting apparatus for grains. This type of sorter has an illumination device for illuminating the grain, and an optical detector with an optical detection section for receiving the light from the illuminated grain. The illumination device employs a source having spectral energy distribution in both the visible light region and the near infrared region. The optical detection section of the optical detection device includes a first light receiving sensor having a high sensitivity to the visible light region and a second light receiving sensor having a high sensitivity to the near infrared region. While this apparatus is intended to be capable of sorting products using both the visible spectra and the near-IR spectra, it was more complex and expensive than a machine having a single type of sensor and illumination source. In addition, the '058 apparatus uses a halogen light source to generate the near-IR illumination.

Halogen light has typically required a greater number of bulbs to provide requisite illumination, as well as consumed significantly more power. The power consumed generated a great deal of undesirable heat, as compared to, for instance, an incandescent or fluorescent bulb.

SUMMARY OF THE INVENTION

The present invention provides a sorter capable of sorting agricultural products using interchangeably either an visible light source or a near-IR light source. By interchangeably using two different light sources, the present invention can efficiently and economically sort a much greater variety of products than those machines described in the prior art. The products are formed into a number of parallel, downwardly falling streams and are sorted based on their illumination intensity as they fall in streams past an illuminated viewing chamber. A suitable number of optical scanning stations, equal to the number of falling streams of product, are located in the viewing chamber. The streams of product are illuminated in the viewing chamber by the selected source of light and the amount of light reflected by the streams of falling product is sensed. Detected unacceptable products and undesirable foreign materials are then rejected.

Preferably, the sorter uses one of two available illumination sources. The first source is a visible light source. The viewing chamber has power providing connection receptacles having a set of mounting points, which include electrical contacts, located hear the falling stream of produce and other objects. Typically, the visible light source is a fluorescent bulb, such as those commonly used in home or commercial lighting fixtures and the mounting points include sockets capable of accepting such bulbs. Any desired number of these bulbs can be used, depending on the nature of the specific application, preferably however, two or four such bulbs are used.

The second illumination source provided for use with the present invention is a near-IR light source. The second source is mounted in a second set of mounting points, also located inside the cabinet, each containing an electrical connector. With the present invention, the mounting points for the second source are accessible for use with the second source but do not interfere with insertion and use of the first light source with it is desired for use. Conversely, the mounting points for the first light source are accessible for connection to that source without interference with access or use of the second light source where its use is required. Therefore, only one type of light source need be present in the cabinet at a time. Typically, an incandescent bulb is used to generate near-IR spectra and the mounting points include sockets capable of accepting such bulbs. It has been found that the incandescent bulb is capable of emitting a near-IR spectrum at a fraction of its rated voltage. Thus, the sorter is able to use less power, generate less heat. Further, at suitable intensity levels for product flow detection and for sensing unwanted debris particles, the service life of the incandescent bulbs is greatly extended.

The sorter according to the present invention is designed to operate with either a first light source in place or a second light source in place. Due to the location of the mounting points, the viewing chamber will typically not accommodate both the fluorescent bulbs and the incandescent bulbs at the same time.

Each light source has a dedicated power supply. For instance, the visible light source will require a high frequency ballast-type power supply, whereas the incandescent/near-IR source may require a direct-current power supply. The power supplies may be selectively energized, such that only one is in use at any given time. For instance, when a fluorescent bulb is being used, only the high voltage alternating current ballast power supply is providing power. In this way, the light source can be switched based on sorting requirements relatively easily without the need to install and remove the power supply as well.

DETAILED DESCRIPTION OF THE PREFERRED EMBODIMENTS

Figure 1:
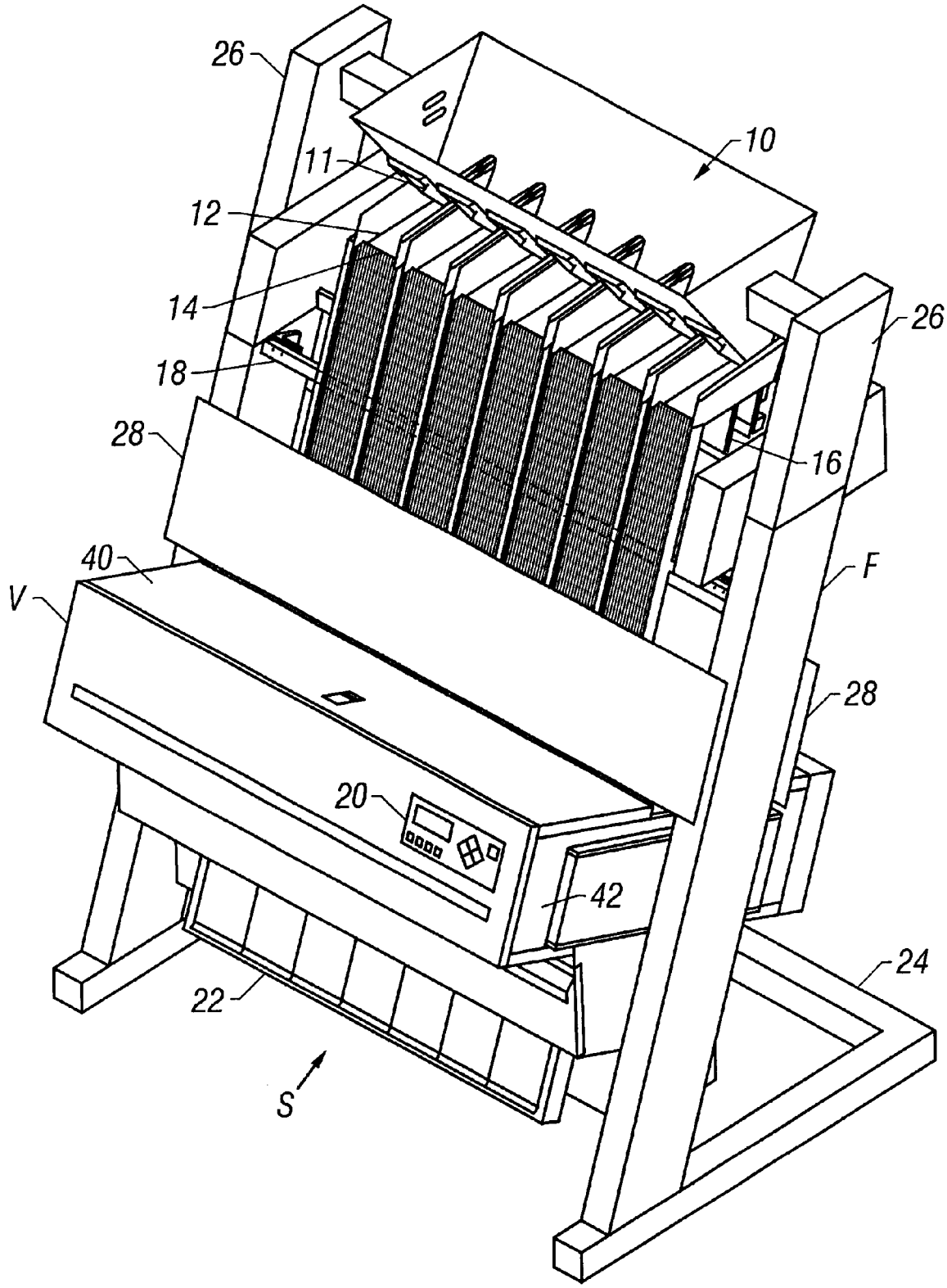
FIG. 1 is an isometric view of a sorter according to the present invention.

In the drawings, the letter S designates generally a sorting apparatus in accordance with the present invention. The sorter S, as shown in FIG. 1, sorts agricultural products into acceptable and unacceptable categories based on color characteristics of the products. The agricultural products may be, for example, coffee beans, sunflower seeds, tree nuts, such as almonds, as well as other fruit and vegetable products.

The sorter S includes an inlet hopper 10 into which product to be sorted is deposited from a suitable source, such as a conveyor system driven by an auger. The sorter S of the present invention includes a frame having a base section 24 and two parallel arm sections 26 which are slightly inclined in the vertical plane transverse the axis of base section 24 from front to back. The arms 26 are generally upright and parallel to each other in a frontal plane co-axial with the longitudinal axis of the base section 24. The inlet hopper 10 is preferably mounted to an intermediate portion of the frame, between the arms 26 and parallel to the base 24. The inlet hopper 10 typically has a plurality of access doors 11, one door being associated with each feeder tray 12, located in the lower region thereof and capable of being opened or closed to control the flow of product to the feeder trays 12.

The stream of product and other possible unwanted articles passes from the inlet hopper 10 into feeder trays 12. The stream of product in the feeder trays 12 is spread out and falls onto a rearwardly slanting corrugated slides 14 which form the product into a number of parallel channels equal in number to the number of optical sensor stations O in the viewing station V.

A vibratory feeder 16 is used to assist in moving the product to be sorted from the inlet hopper 10 to the corrugated slides 14 and is mounted on a crossrail 18 of and located between the feeder trays 12 and the viewing station V. The crossrail 18 extends between the two upright arm sections 26 of the frame and is substantially parallel to the base 24.

The sorter S of the present invention is typically capable of self-cleaning the viewing station V to remove dust and other debris. The flow of product may be temporarily suspended to clear the slides 14 and a blast of air may be blown through viewing station V, thereby removing substantially all of the foreign material present therein. A control panel or panels is preferably located on the outside of the viewing station V. In a preferred embodiment, the sorter may have a safety cover 28 disposed across the arms and covering at least a portion of the slides 14 to prevent accidental injury to personnel operating the machine.

Individual ones of the product and any other items in the stream descending in slides 14 are illuminated by the selected ones of the light sources currently in use in the viewing station V so that all surface portions of the product are illuminated as the product stream passes through the viewing station. Light reflected from the illuminated portions of the surface of the product or object is received by a suitable number of optical sensor stations O. When the color of the individual ones of the product is not within acceptable limits, as determined by the optical sensor stations, an ejector solenoid is activated, producing a jet or blast of air from an ejector which forces the unacceptable product into a discard chute or hopper. Acceptable product passes through the viewing station V into a hopper 22 from which it is fed into a suitable container.

The product in each stream to be sorted descends from the corrugated slide 14 into a space before a focusing lens of an optical station O, one of which is provided for each of the channels in the tray 14. The focusing lens in each of the optical viewing stations O is a part of the sorting optics of the apparatus which focuses light present in the space onto a number of scanning photocells. The scanning photocell for each of the optical viewing stations 0 is in the form of a plurality of aligned photosensors. Any number of photosensors may be included in each photocell, however, an increased number of photosensors results in a greater resolution and thus a more accurate sorter. In a preferred embodiment of the present invention, each photocell includes from thirty to thirty-five photosensors. The photosensors of the present invention may be any of those known in the art, however, silicon-based photosensors are preferred due to their ability to receive light in both the visible and near-IR range.

Each photocell may also have associated therewith an optical filter. The specific characteristics of the optical filter will vary depending on the nature of the illumination source being used. For instance, where an incandescent source is being used, an optical filter capable of filtering light in those portions of the spectrum below the near-IR range may be used. Likewise, where a visible light source is used, an optical filter capable of allowing only light in the visible spectrum to pass may be installed. The filters may be removably mounted in the viewing chamber V so that they may be exchanged when the light source is changed.

As the product descends through the viewing chamber, it is illuminated by the light source. The photocell receives light reflected from the product and generates a signal therefrom. The signal is processed in a conventional manner, such as substantially as described in U.S. Pat. No. 4,697,709, which is herein incorporated by reference. It should be understood, however, that the present invention is not limited to the analog circuitry described in the '709 patent, but may include digital processing circuitry as well. Once the signal is processed, the product may be accepted or rejected based on a comparison between the signal generated at the photocell and a specific reference signal. If the product is unacceptable, or if an unwanted item of debris is sensed, the ejector solenoid is activated, and the product is forced into a discard chute or otherwise removed from the stream of product.

Figure 2:
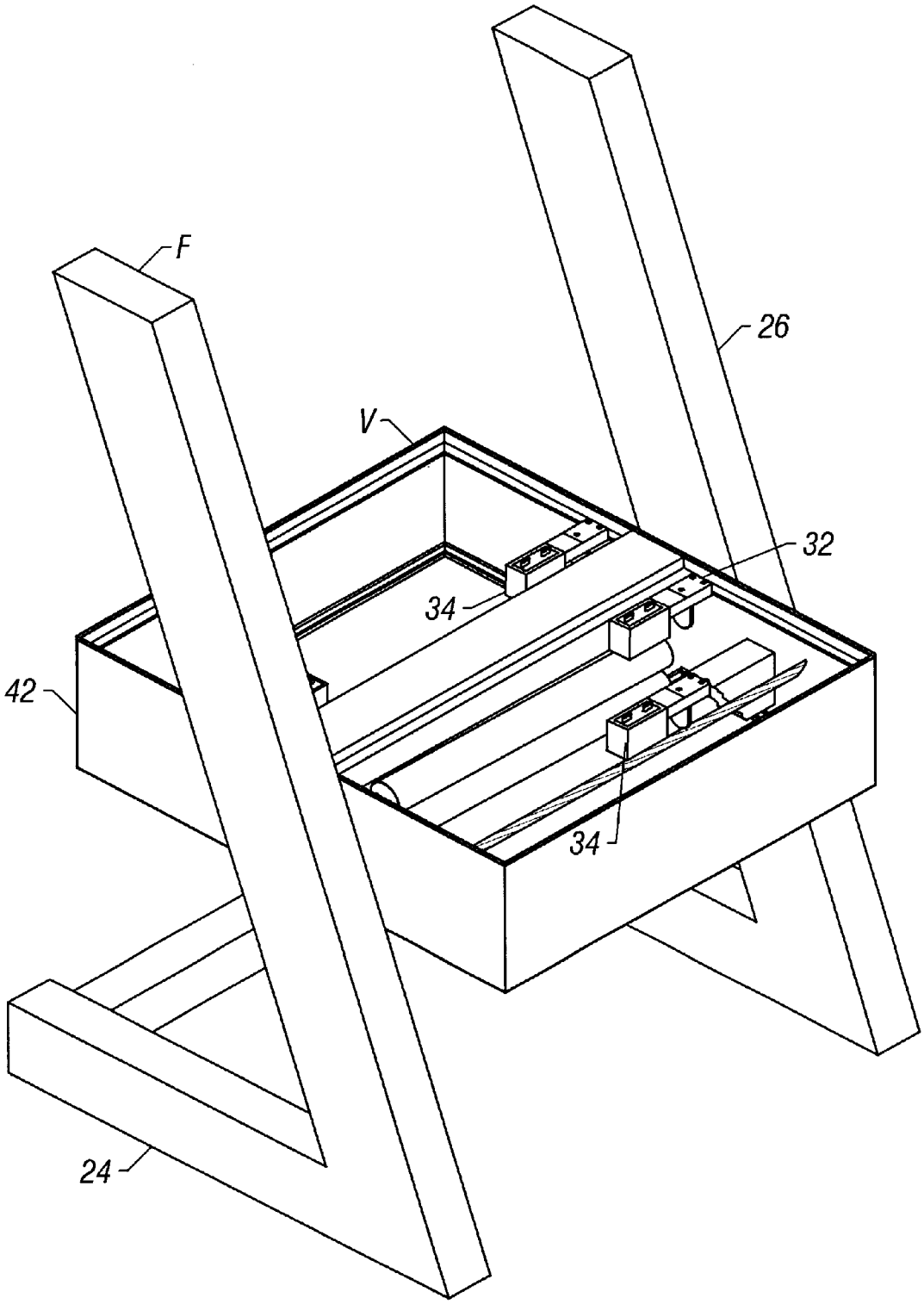
FIG. 2 is an isometric view of portions of the sorter of FIG. 1.
Figure 3:
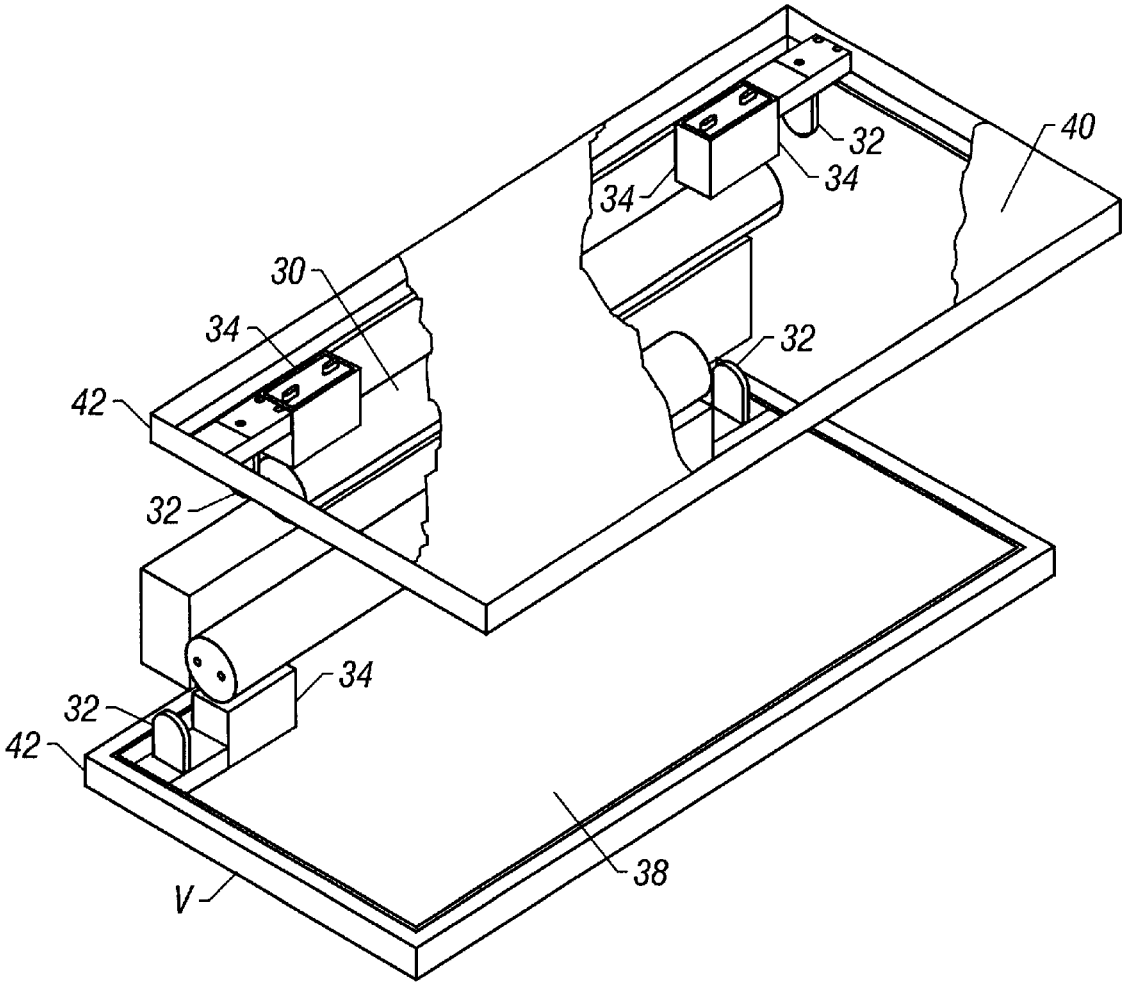
FIG. 3 is an isometric view showing parts of the sorting mechanism of the present invention.

As shown in FIGS. 2 and 3, a plurality of lamps 30 serving as light sources may be located around the periphery of the viewing station V. The viewing station V is adapted to receive either a visible spectrum light source or a near-IR spectrum light source at several peripheral locations. A first set of mounting/power supply connection points 32, each of which contains an electrical connection, is located such that a visible spectrum light source 30, preferably a fluorescent bulb, may be securely fastened therein. In a preferred embodiment the fluorescent lamp is a "F40T12" model, which is standard in the industry. The first set of mounting points 32 are typically provides in two spaced locations in station V on opposite sides of the descending stream being sensed. The mounting points are located in the station V along an inclined plane, as indicated at 48 (FIG. 3) from a focal axis of the optical detectors in order to prevent direct illumination of the detectors and fastened to the side walls 42 of the viewing station V. In this way, a fluorescent bulb of the conventional type or otherwise which is tubular and has an electrical contact located on each end may be mounted to extend laterally across the internal width of the viewing station V, and in a direction transverse the generally vertical flow of product being sorted through the station V.

Figure 5:
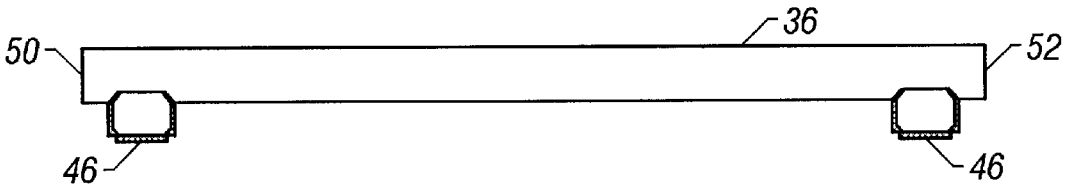
FIG. 5 shows an incandescent bulb useful in the operation of the present invention.
Figure 4:
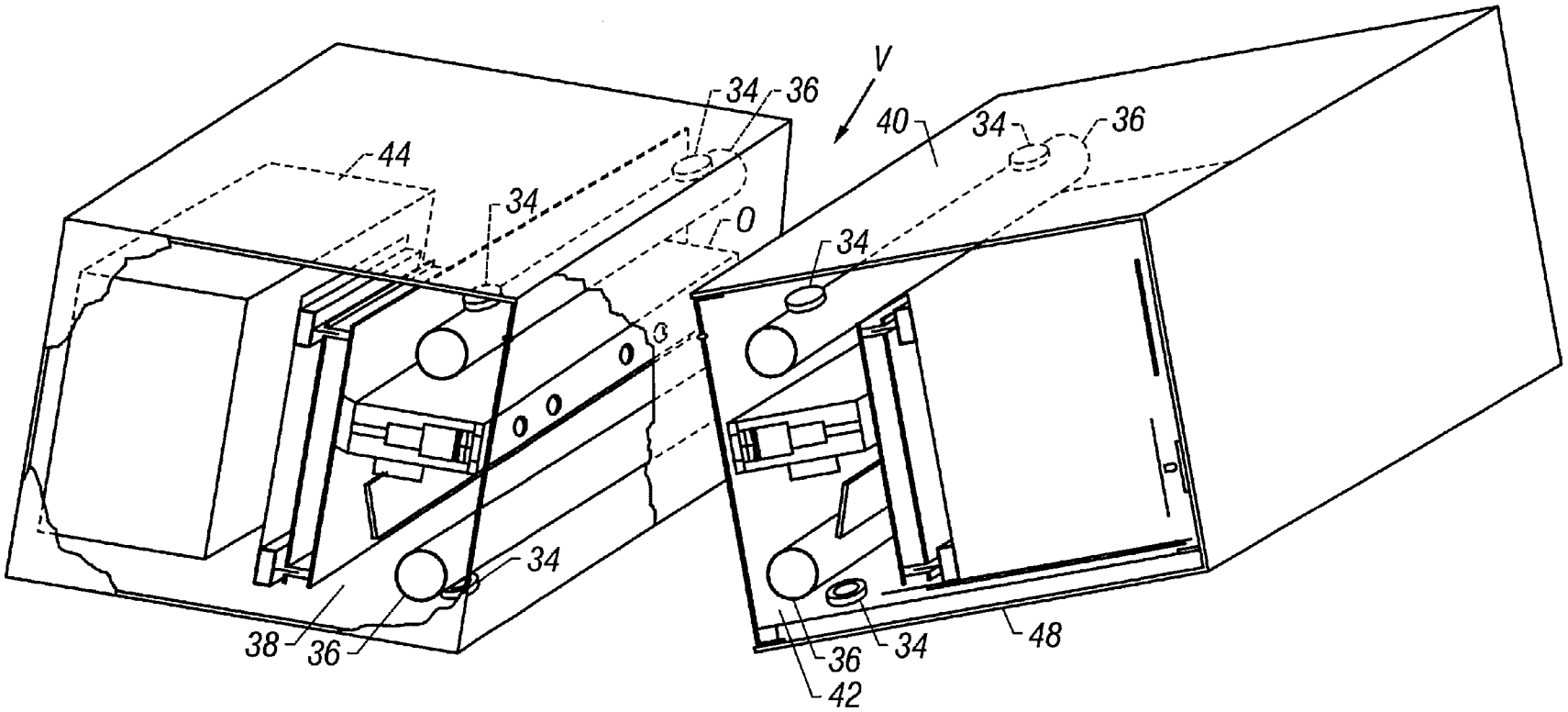
FIG. 4 is an isometric view showing the sorting mechanism and housing of the present invention.

A second set of mounting/power supply connection points 34, each of which contains an electrical connection, is also located within the viewing station V. The second set of mounting points 34 are adapted to receive an incandescent bulb 36, such as that shown in FIG. 5. The bulb 36 emits some visible light, but its purpose for the present invention is to furnish near-IR light as its primary output. The mounting points 34 for the second source 36 are preferably located on the floor 38 and/or the roof 40 of the viewing station V. The second source 36 is preferably an elongate tubular incandescent bulb 36, having electrical contacts 46 located along the length of the tube at paced positions intermediate end portions 50 and 52. Power supply connections for the bulb 46 are hus not located on its end portions of the tube as with fluorescent bulb which serves as the alternate light source. Further, the electrical power receiving contacts for the incandescent are oriented perpendicular to the length of the tube 36.

An example of an incandescent bulb useful in the practice of the present invention is the Osram Linestra linear incandescent bulb, typically rated at 60 watts and 125/130 volts. If desired, a tubular halogen lamp of similar geometry from the same company or from some other vendor may be used as the second light source. Any number of first mounting points 32 or second mounting points 34 of the type described above may be included within the viewing station V, depending on the number of bulbs that are necessary for a specific sorting application requirements. However, it should be understood that only one type of bulb may be installed in the viewing station at any given time. Therefore, where a first product is being sorted which requires a visible spectra, fluorescent bulbs would be installed. If a second product requiring a near-IR spectra was to then be sorted, the fluorescent bulbs would be removed and the incandescent bulbs 36 would instead be installed.

The electrical connections in each set of mounting points are electrically connected to a light source specific power supply 44. For instance, where a fluorescent bulb is being used to generate a visible spectrum, a high frequency ballast-type power supply would be connected to the electrical connections in the appropriate mounting points. Preferably, the high frequency power supply will operate in the 40 kHz range. Likewise, a power supply suitable for operating an incandescent bulb may be connected to the electrical connections in the second mounting. A typical incandescent power supply will operate using direct current with a variable output of from 50v to 120v. Both power supplies are included in the apparatus at a suitable location either on or near viewing station V. However, only one will be providing power at any given time. A suitable control switch may be provided for this purpose. The power supply is typically mounted inside a cabinet adjacent to the viewing chamber V, but may be located anywhere on the frame F.

The foregoing disclosure and description of the invention are illustrative and explanatory thereof, and various changes in the size, shape and materials, components, circuit elements, wiring connections and contacts, as well as in the details of the illustrated circuitry and construction may be made without departing from the spirit of the invention.

We claim:

1. An apparatus for sorting agricultural products based on their color, comprising:

(a) an inlet apparatus comprising an inlet hopper, feed trays and corrugated slides;

(b) a viewing chamber;

(c) an illumination assembly comprising a first set of mounting points having electrical contacts to receive at least a first illumination source and a second set of mounting contacts having electrical contacts to receive at least a second illumination source;

(d) said first set and said second set of mounting points being located such that only one illumination source may be present in the illumination assembly at a time;

(e) an optical station in the viewing chamber for sensing the light reflected from the products as they pass through the viewing chamber;

(f) an ejector for ejecting unacceptable products from the agricultural products being sorted.

2. The apparatus of claim 1, wherein said first illumination source produces light in the visible spectrum.

3. The apparatus of claim 2, wherein said first illumination source is a fluorescent lamp.

4. The apparatus of claim 1, wherein said second illumination source produces light in the near-IR spectrum.

5. The apparatus of claim 4, wherein said second illumination source is an incandescent lamp.

6. The apparatus of claim 4, wherein said second illumination source emits near-IR light at a fraction of its rated voltage.

7. The apparatus of claim 4, wherein said second illumination source is an elongate tubular incandescent lamp.

8. The apparatus of claim 4, wherein said second illumination source is an incandescent light source with a rated voltage and which emits near-IR light at a fraction of its rated voltage.

9. The apparatus of claim 4, wherein said second illumination source further produces visible light.

10. The apparatus of claim 1, further comprising a first power supply for providing power to said first illumination source and a second power supply for providing power to said second illumination source.

11. The apparatus of claim 1, wherein said inlet chute is subdivided into at least two flow paths, each path having an associated optical station.

12. An apparatus for sorting agricultural products based on their color comprising:

(a) an inlet apparatus comprising an inlet hopper, a feed tray and a corrugated slide;

(b) a viewing chamber;

(c) an illumination assembly comprising:

a first set of mounting points having electrical contacts to receive a first lamp capable of producing light in the visible spectrum;

a first power supply to supply power to said first lamp through the electrical contacts;

a second set of mounting points having electrical contacts to receive a second lamp capable of producing light in the near-IR spectrum;

a second power supply to supply power to said second lamp at a level below the rated voltage for the second lamp;

(d) said first and second mounting points located such that only a first lamp or a second lamp may be mounted in the illumination assembly at any given time (e) an optical station in the viewing chamber for sensing the light reflected from the products as they pass through the viewing chamber; and (f) an ejector for ejecting unacceptable products from the agricultural products being sorted.

13. The apparatus of claim 12, wherein said first lamp comprises a fluorescent bulb.

14. The apparatus of claim 12, wherein said second lamp comprises an incandescent bulb.

15. The apparatus of claim 12, wherein said second lamp comprises a halogen bulb.

16. The apparatus of claim 11, further comprising a vibratory motor for the inlet hopper.

* * * * *